US005611234A

United States Patent [19]

Allegrucci et al.

[11] Patent Number: 5,611,234

[45] Date of Patent: Mar. 18, 1997

[54] PROCESS FOR MODIFYING THE SECTION OF A RAILWAY RAIL AND RAIL THUS OBTAINED

[75] Inventors: Jean-Pierre Allegrucci, Schifflange, Luxembourg; Gérard Testart, Andresy, France

[73] Assignee: KIHN, Grand Duchy, Luxembourg

[21] Appl. No.: 380,028

[22] Filed: Jan. 30, 1995

[30] Foreign Application Priority Data

Feb. 15, 1994 [LU] Luxembourg ..... 88458

[51] Int. Cl.[6] ..... B21D 31/00

[52] U.S. Cl. ..... 72/377; 72/342.6; 72/342.94; 72/356; 238/148; 238/150

[58] Field of Search ..... 72/342.6, 342.94, 72/341, 356, 377; 29/402.19, 402.21; 238/148, 150, 122

[56] References Cited

U.S. PATENT DOCUMENTS

| | | | |
|---|---|---|---|
| 1,394,708 | 10/1921 | Braine . | |
| 1,924,838 | 8/1933 | Daley | 29/402.21 |
| 1,951,727 | 3/1934 | Daley | 29/402.21 |
| 2,075,842 | 4/1937 | George | 238/148 |
| 2,170,859 | 8/1939 | Frickey | 238/148 |
| 2,305,711 | 12/1942 | Jones et al. | 29/402.21 |
| 3,133,343 | 5/1964 | Kratkay | 29/402.19 |
| 3,356,276 | 12/1967 | Robinson, Jr. et al. | 238/148 |
| 3,623,207 | 11/1971 | Zoso et al. | 29/402.19 |

FOREIGN PATENT DOCUMENTS

| | | |
|---|---|---|
| A-751242 | 8/1933 | France . |
| C-684200 | 11/1939 | Germany . |
| C-874981 | 3/1953 | Germany . |
| A-0573702 | 12/1993 | Germany . |

*Primary Examiner*—Lowell A. Larson
*Assistant Examiner*—Ed Tolan
*Attorney, Agent, or Firm*—Merchant, Gould, Smith, Edell, Welter & Schmidt, P.A.

[57] ABSTRACT

The process consists in increasing the height of the rail to the detriment of the thickness of the web (16) and of the flange (18). Firstly, the thickness of the upper part of the web (16) below the head (14) is reduced by machining and, next, the rest of the web (16) and the flange (18) of the rail (10) are heated up and deformed by forging. This process avoids hardness modifications of the running surface of the rail.

9 Claims, 1 Drawing Sheet

PROCESS FOR MODIFYING THE SECTION OF A RAILWAY RAIL AND RAIL THUS OBTAINED

BACKGROUND OF INVENTION

The present invention relates to a process for modifying the section of a railway rail comprising a flange, a web and a head, consisting in increasing the height of the rail to the detriment of the thickness of the web and of the flange.

It is well known (see, for example, French Patent No. 751,242) to modify the section of a rail so as to adapt it to that of a rail of different section in order to be able to be welded or attached thereto. This is the case, for example, in points where the heels of the points not only have a greater section, but also a different (for example asymmetrical) shape from that of the rails of the normal track. In order to be able to join the ends of these rails of different sections, the profile of the rail with the greater section is generally deformed over a certain length in order to adapt it to the shape of the adjacent rail. This deformation is carried out by forging, that is to say that the rail is heated to red heat and deformed between the suitably shaped jaws of a press. If there remains an excess of material for the profile desired, it is generally contrived to upset this excess in the flange and to remove it, after forging, by a machining process.

All rails which have undergone such a forging exhibit, somewhere in the transition zone, a section having a reduced hardness which arises from the temperature gradient between that part of the rail which is heated to red heat with a view to forging it and the rest of the rail which is at ambient temperature. This reduced-hardness section results, in the long term, in a slight sag of the running surface in the head of the rail, caused by the repeated passage of the wheels.

Heating the rail to its forging temperature furthermore negatively affects the mechanical properties, especially its hardness over the entire length of the heating. This is all the more serious if the rail has undergone, as is generally the case, a prior heat treatment since the beneficial effects of this treatment are then irremediably lost in this zone.

However, given that these anomalies are relatively minor and have but little influence on the behavior of railway convoys running at low or medium speed, they have, up to now, been of hardly any concern.

On the other hand, with the appearance of high-speed trains, the requirements with respect to the quality of the rails become increasingly strict. However, the sole known means of preventing the appearance of these critical reduced-hardness zones is to prevent the thermal gradients, that is to say to heat the rail to red heat over its entire length in order to forge its end, whereas the sole known means of avoiding these critical zones and of re-establishing its initial hardness is to make the rail undergo, after forging, a heat treatment over its entire length. It goes without saying that one or other of these involves enormous means which considerably burden the manufacturing cost of such a rail.

SUMMARY OF THE INVENTION

The object of the present invention is to provide a novel process for modifying the section of a railway rail which does not affect the surface hardness of the running surface of the rail.

In order to achieve this objective, the process proposed by the invention is characterized in that the thickness of the upper part of the web, below the head, is reduced by machining and in that the rest of the web, as well as the flange of the rail, are heated up and deformed by forging.

Preferably, the heating to red heat is carried out by a localized inductive process. In this way, only the portion still requiring forging is heated to the temperature necessary for forging.

The machining of the head and of the upper part of the web makes it possible to heat up locally only the lower part of the rail with a view to forging it. Furthermore, as a result of the machining of the upper part of the web, the head lies further away from the hot zone of the lower part, whereas the constriction reduces the horizontal section of the thermal conduction flux from the base to the head, so that, while the lower part of the rail is being heated up to its forging temperature, the temperature of the running surface of the head of the rail remains well below the critical temperature for irreversible modification of its hardness.

In other words, the mechanical properties, especially the hardness of the running surface of the rail, are not affected by the heating, thereby making it possible, inter alia, to guarantee retention of the effects of a prior heat treatment.

As a result of the local heating of the lower part of the rail, it is even possible simultaneously to cool the head of the rail.

BRIEF DESCRIPTION OF THE DRAWINGS

Other features and characteristics of the invention will emerge on reading an advantageous embodiment presented hereinbelow, by way of illustration, with reference to the appended drawings in which.

DETAILED DESCRIPTION

Figure 1:
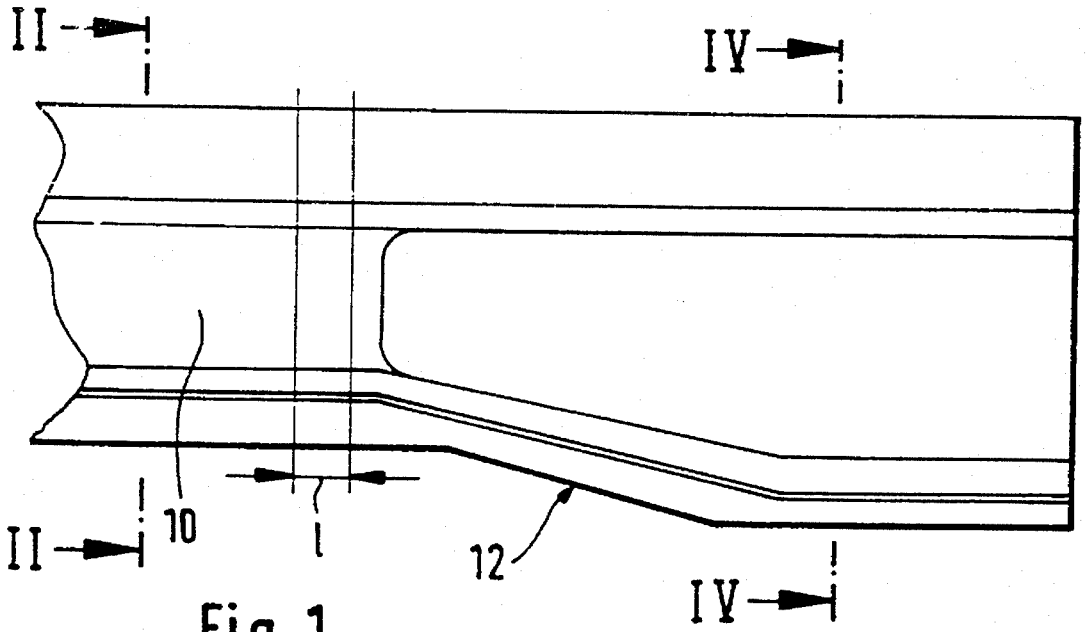
FIG. 1 shows diagrammatically a side view of a rail, one end of which has been modified by forging.
Figure 2:
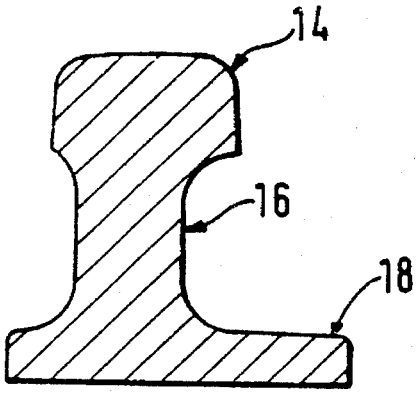
FIG. 2 shows diagrammatically a section in the cutting plane II—II of FIG. 1.

The rail 10 represented in FIG. 1 is, by way of example and as FIG. 2 shows, a rail having an asymmetric section. However, it is necessary to point out that the invention is not limited to this type of rail.

Figure 4:
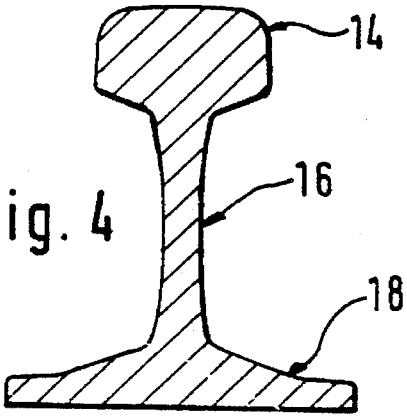

In order to be able to connect this rail, for example by welding, to the rail of a normal track having a more slender symmetrical section, the section of the right-hand end in FIG. 1 is deformed in order to have the profile of FIG. 4.

If this deformation is carried out conventionally by forging, the rail has, slightly in front of the transition zone 12 between the two different sections, over a certain length 1, an anomaly, more precisely a lower hardness than over the rest of the length of the rail, whereas, over the entire length of the forging zone, the mechanical properties of the rail have been modified by the heating, so that the hardness thereof is also reduced. Since these modifications to the properties of the rail also affect the running surface, they may run the risk of premature wear of the rail and disrupt the running of high-speed convoys.

Figure 3:
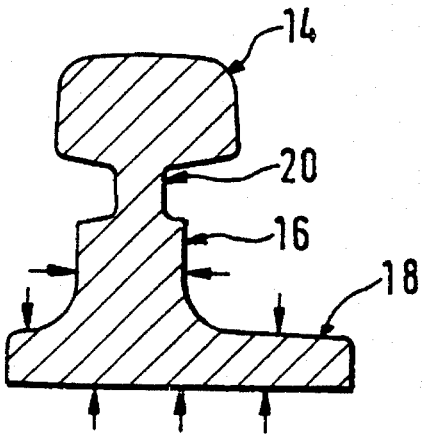
FIG. 3 illustrates the section of the rail after machining the upper part and before forging the lower part and FIG. 4 represents the final section of the rail seen in the plane of cutting IV—IV of FIG. 1.

In order to prevent the formation of this anomalous zone in the surface of the head 14 of the rail 10, the head 14 and the upper part of the web 16 are machined to the profile according to FIG. 3. However, in many cases, the profile of the head 14 of the rail with the section as in FIG. 2 already corresponds to the final shape as in FIG. 4, so that the machining is limited, in this case, to machining, in the upper part of the web 16, a constriction 20 by milling on each side of the rail 10 below the head 14 a longitudinal groove in the web so as to reduce its thickness, preferably down to the final thickness of FIG. 4.

The deformation of the lower part of the rail 10 for reaching the final profile of FIG. 4 is carried out by forging, which consists in lengthening the web 16 and reducing its thickness down to that of the constriction 20 and in possibly adapting the profile of the flange 18. According to one of the aspects of the present invention, heating the entire section of the rail 10 to red heat is avoided and only the lower part of the rail is heated locally over the length requiring forging. For this purpose, electromagnetic inductors with localized action, as symbolized by the arrows in FIG. 3, are used.

The preliminary machining of the upper part of the web 16 has, in addition to the fact of thinning the region 20 down to the final thickness, a double beneficial action from a thermal standpoint. Firstly, the head 14, and more particularly the critical region of the running surface, lies further away from the part heated to red heat for forging. In addition, the constriction 20 reduces the section for the thermal conduction flux and thus decreases the propagation of heat into the head 14 of the rail, so that the lower part of the rail can be heated to red heat without the temperature in the region of the running surface reaching the critical threshold for modification of the physical properties of the rail.

It is true that a reduced-hardness zone always remains, but this zone is limited to the flange 18 and to the base of the rail, that is to say to a region which is not directly stressed by the convoys. On the other hand, the head 14 of the rail, especially the running surface, preserves its initial hardness over the entire length of the rail.

We claim:

1. Process for modifying a section of a railway rail comprising a flange, a web and a head, by increasing a height of the rail to a detriment of a thickness of the web and of the flange, the process comprising the steps of:

machining an upper part of the web below the head to reduce a thickness of the upper part of the web;

directing heat to only a lower part of the web, and the flange of the rail; and deforming heated portions of the rail to increase the height of the rail.

2. Process according to claim 1, wherein the machining step reduces the thickness of the upper part of the web a final thickness.

3. Process according to claim 1, wherein the heating step comprises the step of heating selective portion of the rail using a localized inductive process.

4. Process according to claim 3, wherein the heating step further comprises the step of cooling the head of the rail while the web and the flange are heated.

5. A method of reshaping a rail section, the rail section including a head, a web and a flange, the method comprising the steps of:

machining a first portion of the web near the head to reduce a thickness of the first portion to a predetermined web thickness;

selectively heating the flange and a second portion of the web near the flange to a forging temperature while maintaining the head below a predetermined temperature; and deforming the second portion of the web and the flange while heated to the forging temperature to increase and reshape the rail section.

6. A method as recited in claim 5, wherein the predetermined thickness is substantially equal to a final thickness of the web.

7. A method as recited in claim 5, wherein the predetermined head temperature is below a critical temperature at which a physical property of the head is altered.

8. A method as recited in claim 7, wherein the physical property is a hardness of the head.

9. A method as recited in claim 5, wherein the selectively heating step comprises the step of inducing localized action in the flange and the second portion of the web near the flange using electromagnetic inductors.

* * * * *